US006112920A

United States Patent [19]

Lahaussois

[11] Patent Number: 6,112,920

[45] Date of Patent: Sep. 5, 2000

[54] CHILD-PROOF, SENIOR-FRIENDLY PILL BOTTLE CLOSURE

[76] Inventor: Pierre Lahaussois, 25-13 Old Kings Hwy. North, Darien, Conn. 06820

[21] Appl. No.: 09/503,857

[22] Filed: Feb. 14, 2000

[51] Int. Cl.[7] ..... B65D 50/08; B65D 39/12; B65D 39/16

[52] U.S. Cl. ..... 215/213; 215/225; 215/305; 215/359; 220/281; 220/787

[58] Field of Search ..... 215/201, 211–213, 215/216, 224, 225, 295, 296, 303, 305, 317, 321, 358, 359; 220/281, 784, 786, 787, 788, 789, 790, 324, 234

[56] References Cited

U.S. PATENT DOCUMENTS

| | | | |
|---|---|---|---|
| Re. 12,032 | 9/1902 | Schmitt . | |
| Re. 31,101 | 12/1982 | Berghahn et al. . | |
| 572,338 | 12/1896 | Detrick . | |
| 770,281 | 9/1904 | Green . | |
| 905,431 | 12/1908 | Hunt, Jr. . | |
| 2,935,219 | 5/1960 | Smith | 215/358 X |
| 3,099,361 | 7/1963 | Ruetz . | |
| 3,262,601 | 7/1966 | Formo . | |
| 3,346,135 | 10/1967 | Haitsch . | |
| 3,430,796 | 3/1969 | Berg | 215/213 X |
| 3,578,193 | 5/1971 | Steiner . | |
| 3,599,821 | 8/1971 | Eggert et al. . | |
| 3,604,583 | 9/1971 | Linkletter | 215/213 |
| 3,703,975 | 11/1972 | Wittemer | 215/213 |
| 4,008,820 | 2/1977 | Ruetz . | |
| 4,231,486 | 11/1980 | Bock . | |
| 4,676,393 | 6/1987 | Daniel . | |
| 4,691,839 | 9/1987 | Ullman . | |
| 4,809,871 | 3/1989 | Angelchik . | |
| 5,038,958 | 8/1991 | Dreier . | |
| 5,105,965 | 4/1992 | Ullman . | |
| 5,704,502 | 1/1998 | Greenfield . | |

FOREIGN PATENT DOCUMENTS

| | | |
|---|---|---|
| 460139 | 8/1949 | Italy . |
| 1 441 383 | 6/1976 | United Kingdom . |

*Primary Examiner*—Nathan J. Newhouse
*Attorney, Agent, or Firm*—Schweitzer Cornman Gross & Bondell LLP

[57] ABSTRACT

A child-proof, senior-friendly safety closure for medicine containers is formed with a cylindrical wall including a continuous mid-level band and slotted upper and lower walls. The slotted walls, in conjunction with the mid-level band, form a plurality of lever-like locking elements which can be pivoted about the region of the mid-level band with which they are integrally associated. The associated receptacle is formed with a dispensing neck having an internally projecting locking flange arranged to engage with notches at lower ends of each of the cylindrically arrayed locking levers, the latter being resiliently biased to remain in locking engagement with the flange. To release the cap, an adult finger is inserted downward into the upper end of the cap, the dimensions of which are such that insertion of an adult finger causes the upper ends of the locking levers to be displaced radially outward. Radially outward displacement of the upper ends simultaneously releases the lower ends of the locking levers from the locking flange and allows the cap, which now is in a gripping relation to the finger, to be removed by withdrawing the finger. The internal diameter of the cap is such that the finger of an infant or young child is not large enough to displace all of the locking levers, and displacement of only a few of them is not effective to release the cap.

7 Claims, 2 Drawing Sheets

FIG. 1
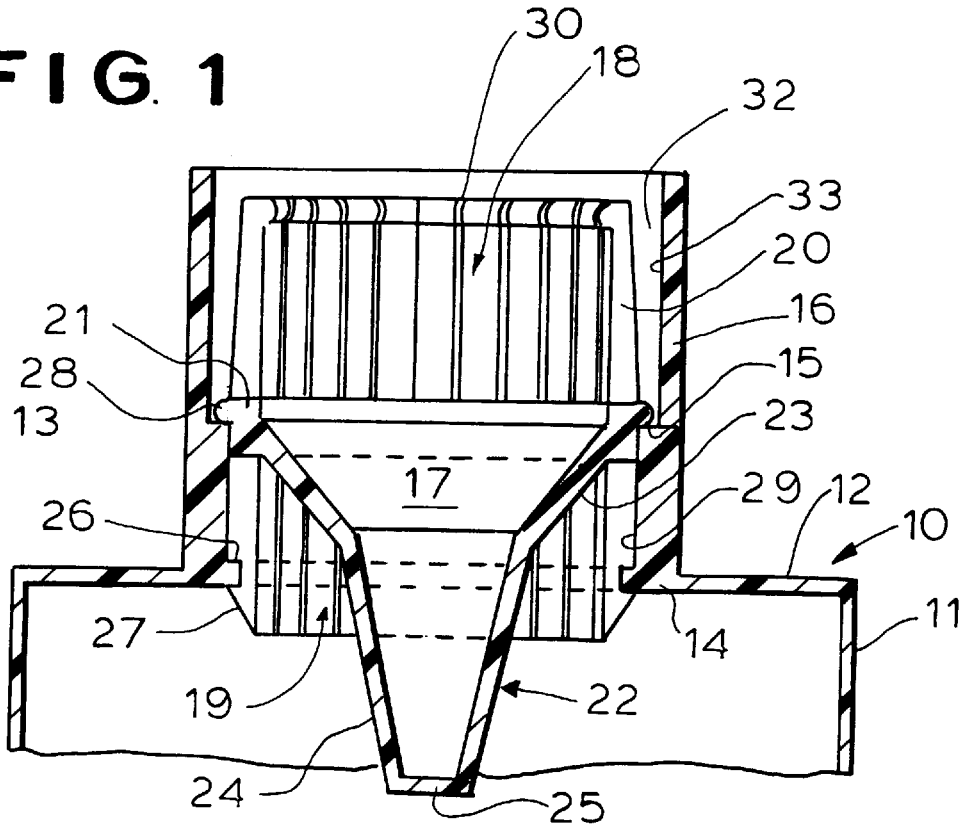
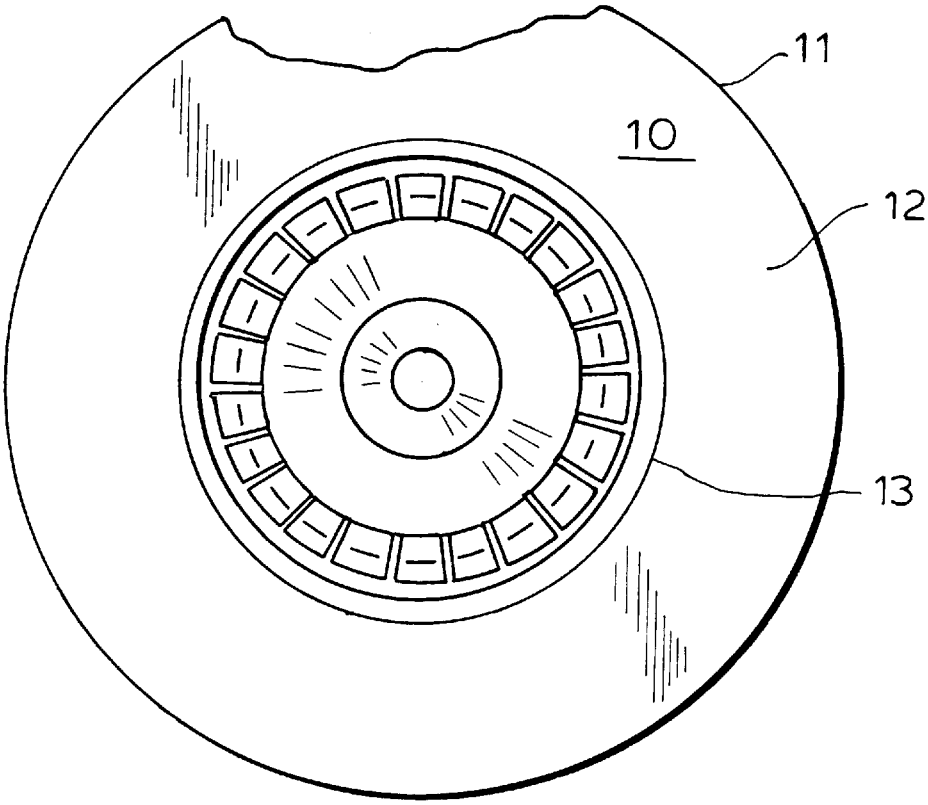
FIG. 2

CHILD-PROOF, SENIOR-FRIENDLY PILL BOTTLE CLOSURE

BACKGROUND AND SUMMARY OF THE INVENTION

The present invention is directed to so-called child-proof closures for pill bottles and the like, and particularly to improvements in such closures rendering the contents of a container utilizing such closures to be more accessible to adults and elderly individuals.

The problem of restricting the access of infants to medicine bottles is well known. In response to a developing problem of accidental poisonings of infants by household prescription drugs resulted in the substantially universal use of child-proof closures designed to frustrate opening of the container by infants and small children. Commonly utilized designs of such child-proof closures include caps that are required to be aligned in a specific rotational orientation to permit opening, caps that require downward pressure on the top of the cap to engage an inner cap for the necessary unscrewing rotations, or to release the cap from a locking device. While many of these known child-proof closure designs are reasonably effective for their primary intended purposes, an unwanted side effect has been to make the medicine containers difficult for many adults to open, particularly the elderly, persons with poor eyesight or physical problems with their hands, for example. A result of this is that, in many households, adults who have difficulty opening "child-proof" containers, may tend to simply remove the caps and leave the bottle open, totally defeating the purpose of providing the child-proof closure in the first place. The problem currently is recognized as becoming increasingly serious because of a demographic trend for grandparents and grandchildren to be living in the same households.

In accordance with the present invention, a novel and improved form of child-proof bottle closure is provided, which, while being entirely effective to frustrate removal by infants and young children, is "senior-friendly" in that it can be easily removed and replaced by the elderly, as well as persons with a variety of disabilities. In particular, the cap of the invention is designed to require insertion of a single finger into the upper end of the cap, in order to release its locking mechanism. The cap, when thus released, grips the finger and is removed from the container by the simple act of withdrawing the finger from the neck of the container. All that is necessary for an adult to remove the cap is insertion of the finger into the cap and subsequent withdrawal of the finger, bringing with it the cap.

Pursuant to the invention, the dimensions of the cap are such that it cannot be released by insertion of an infant's finger into the entry of the cap. Indeed, if the infant's finger is inserted sufficiently far into the cap, it will tend, if anything, to lock the cap tighter to the neck of the bottle.

For a more complete understanding of the above and other features and advantages of the invention, reference should be made to the following detailed description of a preferred embodiment of the invention and to the accompanying drawings.

DESCRIPTION OF THE DRAWINGS

FIG. 1 is a fragmentary cross sectional view of the child-proof closure of the invention, shown in an installed and locked position in a medicine container or the like.

FIG. 2 is a top plan view of the cap and container of FIG. 1.

DESCRIPTION OF PREFERRED EMBODIMENTS

Figure 3:
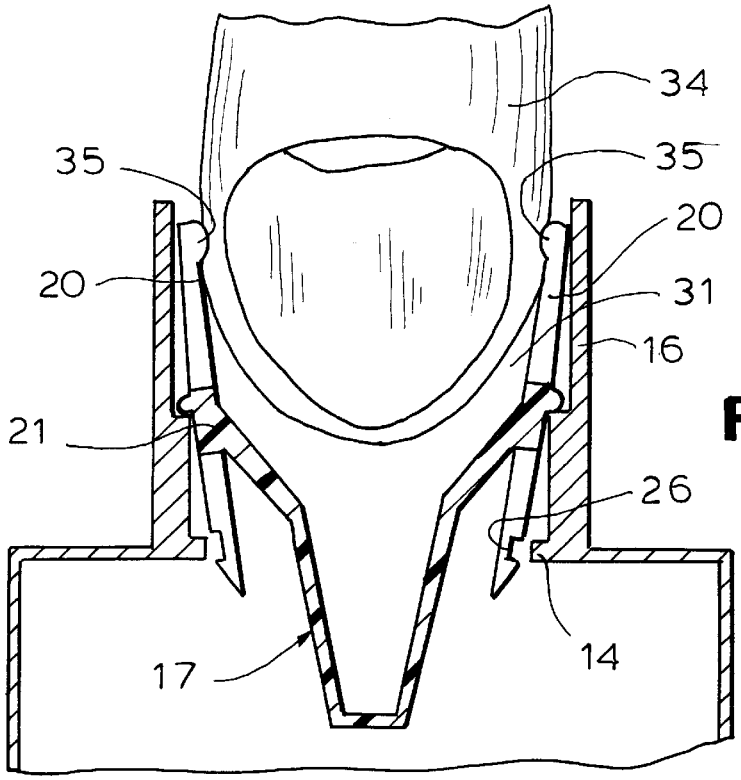
FIG. 3 is a cross sectional representation of the cap and container of FIG. 1 illustrating the manner in which the cap is released and removed by insertion of an adult finger.

Referring now to the drawings, and initially to FIGS. 1 and 2 thereof, the reference numeral 10 designates generally a receptacle for pills, liquids and other materials to which access by infants and young children is to be restricted. The container 10 has side walls 11, a top shoulder 12 and an upwardly projecting dispensing neck 13. As far as the invention is concerned, the portions of the container below the shoulder 12 may be of any suitable size and shape. The neck 13 preferably is of circular cross sectional configuration, at least internally.

On the inside of the neck 13, conveniently but not necessarily at the bottom thereof, there is an inwardly projecting circular locking flange 14. Above the locking flange, there is an upwardly facing sealing shoulder 15, and a circular spout 16 extends upward from the sealing shoulder 15.

Pursuant to the invention, a sealing cap, generally designated by the reference numeral 17, is adapted to be received within the neck 13, in sealing engagement with the sealing shoulder 15, and in locking engagement with the locking flange 14. The cap 17 is of generally cylindrical configuration, having a slotted upper wall portion 18 and a similarly slotted lower wall portion 19. The slots of the upper and lower wall portions are aligned and form a plurality of lever-like locking elements 20 integrally joined by a cylindrical band 21, which is formed around the mid-level of the cap 18. It is contemplated that the entire cap 17 will be formed in one piece by injection molding, using a suitable structural plastic material. A sealing diaphragm portion 22 is formed integrally with the mid-level band 21 and extends across the interior of the cap. In the illustrated form of the invention, the sealing diaphragm 22 is funnel shaped, defined by an upper conically shaped portion 23 and a lower conically shaped portion 24, the latter being closed at the bottom by a bottom wall 25.

Pursuant to the invention, each of the lever-like locking elements 20 is formed adjacent to but spaced upward from its lower end extremity with an outwardly facing locking notch 26 of a size and shape to receive the locking flange 14. Additionally, the lower end extremity of each locking element is formed with an inclined guide surface 27.

Externally of the mid-level band 21, there is formed an outwardly projecting sealing flange 28 arranged to cooperate with the sealing shoulder 15 for closing and sealing the container. As is evident in FIG. 1, the dimensional relationships of the cap 17 are such that, when the notches 26 of the locking levers are fully engaged with the locking flange 14 of the container, the sealing flange 28 is snugly positioned against the sealing shoulder 15. Also, as indicated in FIG. 1, the external diameter of the mid-level band 21 is such that it is closely received within the internal wall 29 of the neck, below the shoulder 15, to firmly locate and position the cap when it is fully received in the container.

As initially formed in the molding process, the cap is configured such that the lever-like locking elements 20 are splayed radially outward slightly at the bottom at their lower ends relative to the configuration shown in FIG. 1. When the cap is inserted into the neck of the receptacle, the inclined guide surfaces 21 will slide over the inner edge of the shoulder 15, and will further be deflected inwardly by the locking flange 14 as the cap approaches its fully seated position. When the cap is fully seated, the locking levers are resiliently biased to snap over the locking flange, engaging it in the manner shown in FIG. 1 such that upwardly facing surfaces of the notches 26 engage downwardly facing surfaces of the flange 14 to lock the cap firmly in place in the neck of the receptacle. In this respect, it will be understood that the slots 30 between individual locking levers, while being quite narrow, are sufficiently large to accommodate the necessary small amount of radially inward movement of the upper and lower ends of the locking levers 20, during insertion and removal operations of the cap.

Removal of the cap 17 of the invention is effected in the manner shown in FIG. 3, by the insertion of a single, adult-size finger into the upwardly open cavity in the center of the cap. When the adult-size finger enters the cavity 31, the upper ends of the individual locking levers 20 are displaced radially outward, pivoting around the continuous mid-level band 21. The clearance space 32 (FIG. 1) provided between the outer surfaces of the locking levers and the inner surface 33 of the spout is such as to allow sufficient radially outward tilt of the upper ends of the locking levers to completely release the notches 26 from the locking flange 14. Simultaneously, the adult-size finger, indicated by the reference numeral 34 in FIG. 3, is grippingly engaged by inward projections 35 provided at the upper end extremities of the locking levers. Accordingly, once the finger 34 has been inserted sufficiently to release all of the locking levers, the finger can be withdrawn from the spout 16, and the cap 17 remains attached to the finger and is removed with it.

Re-insertion of the cap can be accomplished while the cap remains attached to the finger, by tilting the finger, after the cap has been seated, sufficiently to enable at least some of the locking levers to engage the locking flange 14. The cap can also be simply pressed into position, if desired, after being removed from the finger.

Figure 4:
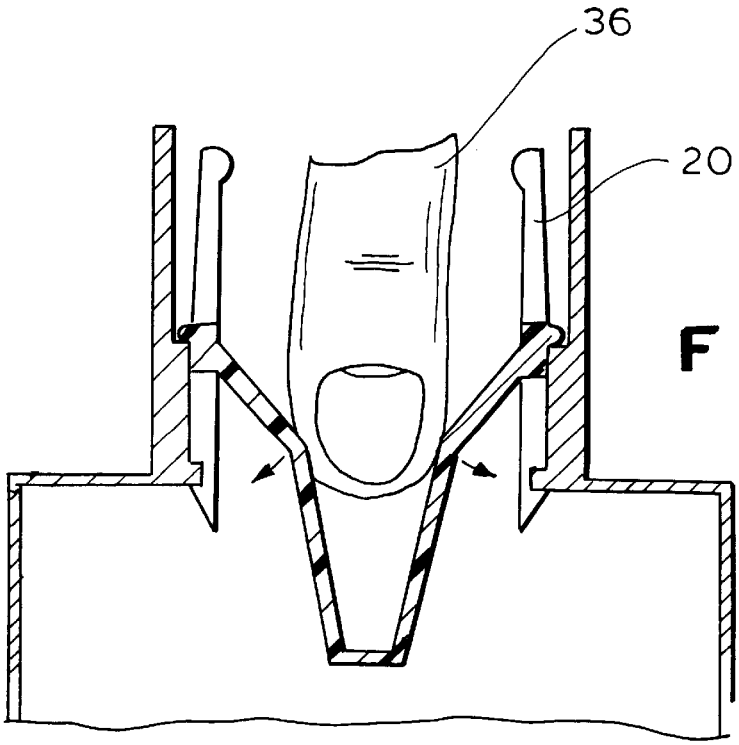
FIG. 4 is a cross sectional illustration showing the manner in which an infant finger, inserted in the cap, is ineffective to release it for opening.

In FIG. 4, it is shown that insertion of the finger 36 of an infant or young child cannot open the cap, because the finger is not of large enough diameter to displace outwardly all of the locking levers 20. Even if the infant presses against the side of the cap and releases some of the levers, most of them remain undisplaced and retain the cap in its locked position. Even if the child or infant attempts to open the cap by inserting two fingers into the opening, to displace locking levers from opposite sides of the cap, there still remain more than an adequate number of engaged levers to prevent the cap from being released.

A uniquely advantageous feature of the invention is that, while child-proof safety is not in any way compromised, access to the receptacle by adults is actually facilitated in a significant way. For example, an elderly person, whose hands may be weak or compromised by restricted movement ability or pain, can access the medicine container by simply inserting a single finger into the cap and withdrawing the finger. Moreover, the medicine can be dispensed without even releasing the cap. Typically, the receptacle will be held in one hand, while the cap is removed by a finger of the other hand. The receptacle can then be tilted and the required number of pills dispensed into the palm of the hand retaining the cap. For a reasonably facile individual, the cap can easily be replaced while retaining the dispensed pills in the hand. Even where that is not possible, however, the entire operation is greatly simplified and facilitated with the new closure of the arrangement.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A child-proof, senior-friendly safety closure for containers, which comprises (a) a container having a dispensing neck formed internally with locking surface areas and a first abutment surface spaced from said locking surface areas, (b) a locking closure cap, formed of an elastic material, adapted for reception within said dispensing neck and having a second abutment surface engageable with said first abutment surface when said cap is received within said dispensing neck, (c) said cap having a generally cylindrically configured outer wall structure comprised of a plurality of vertically oriented, independently movable lever shaped locking elements arranged in angularly spaced relation and a mid-level band joining said locking elements in a limited region thereof between upper and lower end portions thereof, (d) lower end portions of said locking elements having locking shoulders adapted for engagement with the locking surface areas of said dispensing neck when said cap is seated therein, to prevent unintended removal of the cap, (e) a closure diaphragm extending across the cross section of said cap in the region of said mid-level band, (f) upper end portions of said locking elements being spaced radially inwardly from and being surrounded by walls of said dispensing neck, (g) said upper end portions being displaceable radially outwardly by insertion of an adult-sized finger axially into an upper end of said cap to cause said locking elements to be pivoted about said mid-level band to effect radially inward displacement of lower end portions of said locking elements and disengagement of the locking shoulders of said locking elements from the locking surface areas of said dispensing neck for removal of said cap from said dispensing neck.

2. A safety closure according to claim 1, wherein (a) said locking surface areas are formed by a circular locking flange projecting inwardly from walls of said dispensing neck, and (b) the locking shoulders of said locking elements comprising recesses in lower end portions of said locking elements adapted for engagement with said circular locking flange.

3. A safety closure according to claim 2, wherein (a) lower end portions of said locking levers are formed with inclined end surfaces, (b) said end surfaces being engageable with said circular locking flange to effect radially inward displacement of lower end portions of said locking levers upon insertion of said cap into said neck.

4. A safety closure according to claim 1, wherein (a) said first abutment surface comprises an upwardly facing annular surface formed in said dispensing neck and spaced above said locking surface areas.

(b) said second abutment surface forming part of said mid-level band and projecting radially outward therefrom to overlie said first abutment surface.

5. A safety closure according to claim 4, wherein (a) said first and second abutment surfaces are continuous circular surfaces adapted to have sealing engagement when said cap in a closed position in said dispensing neck, (b) said second abutment surface is joined continuously with said mid-level band, (c) said closure diaphragm being joined continuously with said mid-level band whereby said second abutment surface, said mid-level band and said closure diaphragm together forming a sealing closure for said container.

6. A safety closure according to claim 1, wherein (a) upper end portions of said locking elements are formed with radially inwardly projecting, finger-engaging elements whereby, when said locking levers are displaced by insertion of a finger into the upper end of said cap, said finger-engaging elements continue to grip the finger to enable said cap to be removed from said dispensing neck by withdrawal of the finger from said neck.

7. A safety closure according to claim 1, wherein (a) said closure diaphragm being joined at outer edges thereof with said mid-level band and having a central portion accessible from top portions of said cap, (b) said closure diaphragm being operative, when downward pressure is applied thereto, to tend to pivot said mid-level band and said locking levers in a direction to increase locking pressure applied by said locking levers.

* * * * *